US005163862A

United States Patent [19]

Philips et al.

[11] Patent Number: 5,163,862

[45] Date of Patent: Nov. 17, 1992

[54] TRIANGULAR BLOCK TOY SET

[76] Inventors: E. Lakin Philips, 2733 Centerville Rd., Herndon, Va. 22071; Ronald L. Benedict, 12840 Mount Royal La., Fairfax, Va. 22033; Rita G. Olson, 1850 MacArthur Dr., McLean, Va. 22101

[21] Appl. No.: 789,806

[22] Filed: Nov. 12, 1991

Related U.S. Application Data

[63] Continuation of Ser. No. 592,625, Oct. 4, 1990, abandoned.

[51] Int. Cl.[5] ..... A63H 33/08

[52] U.S. Cl. ..... 446/114; 446/118

[58] Field of Search ..... 446/114, 118, 109, 124, 446/112, 113, 125; D21/108

[56] References Cited

U.S. PATENT DOCUMENTS

| | | | |
|---|---|---|---|
| 1,311,337 | 7/1919 | Fredson | 446/114 |
| 2,023,300 | 12/1935 | Barnett | 446/118 |
| 2,751,706 | 6/1956 | Metal | 446/114 |
| 2,883,764 | 4/1959 | Stephens | 446/118 |
| 3,537,706 | 11/1970 | Heavener, Jr. | D21/108 X |
| 3,564,758 | 2/1971 | Willis | 446/109 |
| 3,698,124 | 10/1972 | Reitzel et al. | 446/114 |
| 3,991,511 | 11/1976 | McAllister et al. | 446/114 |

*Primary Examiner*—Mickey Yu

*Attorney, Agent, or Firm*—Lane, Aitken & McCann

[57] ABSTRACT

In a block set toy, the block set having a plurality of identical subsets of triangular blocks, each block being in the form of a thin sheet having internal rectilinear slots and rectilinear side slots defined therein. The sheets are about ⅛th of an inch in thickness and the slots have a width slightly greater than ⅛th of an inch. Shallow triangular notches are formed in the sides of some of the blocks. A grooved base block is provided for supporting the blocks vertically. The blocks can be interconnected to a highly cantilevered structure.

9 Claims, 3 Drawing Sheets

TRIANGULAR BLOCK TOY SET

This application is a continuation of application Ser. No. 529,625, filed Oct. 4, 1990, abandoned.

This invention relates to block set toys and, more particularly, to a block set toy comprising blocks in the form of thin, triangular sheets.

Prior to the present invention, it has been known to provide block set toys in which the blocks are in the form of thin, triangular sheets which can be interconnected into complex structures. The present invention improves on these prior art block sets by providing a structure and shape to the blocks which enables the blocks to be interconnected into a wide variety of shapes permitting airy and highly cantilevered unusual structures which cannot be constructed with the block sets of the prior art. The variety and the airiness of the highly cantilevered structures that can be constructed with the block set of the present invention and greatly increase the play value of the block set and stimulates creativity in preschool and early primary grade school children.

SUMMARY OF THE INVENTION

The block set of the invention comprises a plurality of subsets with each subset comprising a multiplicity of identical blocks each in the form of a thin, triangular sheet, having a plurality of slots extending from the edge of the triangular sheet and a plurality of internal slots within the perimeter of the triangular sheet. The slots have a width a little larger than the width of the triangular sheets so that the other blocks of the block set can be inserted in to the slots and make a loose fit with the slot when so inserted. The triangular sheets are thick enough so that one block will support another inserted into a slot of the first block in an orthogonal relationship. The triangles of each subset are of different sizes and different shapes to provide a greater variety in the structures that can be created with the block set. The triangle of at least one other subset defines a right triangle of a vertex. The triangles of all of the subsets are scalene and contain at least one angle - at one of its vertices at an angle less than 45 degrees. Preferably, some of the subsets of the blocks include a shallow triangular notch along one side in the form of a short edge perpendicular to the side of the triangle extending into the triangle and long edge gradually sloping back to the side of the triangle. The shallow triangular notches can be used to provide additional structural support to the assemblies made from the blocks. In addition to the triangular sets, a base block is provided defining grooves extending at right angles designed to fit with the triangular blocks into which the edges of the blocks to provide a base support for an assembly of the blocks.

Because of the triangular shapes of the blocks, they can be tesselated into regular geometric or familiar patterns, such as rectangles, parallelograms and other familiar shapes, making the blocks a teaching toy to give children an understanding of geometrical shapes and basic mathematical relationships.

DESCRIPTION OF A PREFERRED EMBODIMENT

In a preferred embodiment of the invention, the block set comprises four subsets of twelve identical blocks each, the blocks of each subset being illustrated in FIGS. 1–4.

As shown in these figures, all of the blocks are made of thin, triangular sheets about $\frac{1}{8}$th of an inch thick and are preferably made of wood. In the preferred embodiment, all of the triangular shapes are scalene triangles, each of which defines an angle at least one vertex of less than 45 degrees. All of the triangular corners of the blocks at the vertices are rounded for safety reasons. The triangular sheets are formed with a plurality of internal rectilinear slots formed entirely within the perimeter of the triangular sheets and a plurality of open ended side slots extending in from the triangular perimeter of the blocks. The internal slots and the side slots are slightly greater in width than the $\frac{1}{8}$th thickness of the sheets so that the slots will receive the other blocks of the set and the $\frac{1}{8}$th thickness of the sheets will support the other blocks in an orthogonal cantilevered relationship.

Figure 1:
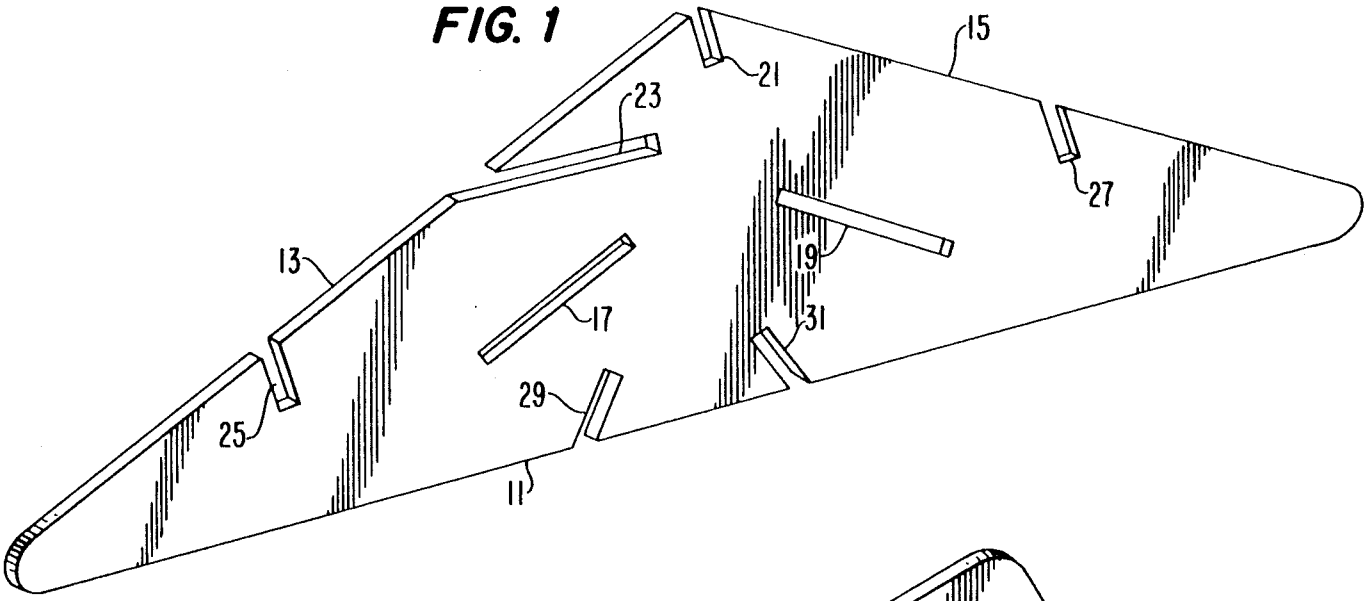
FIGS. 1–4 are each a perspective view of a block of a different one of the subsets of a set of blocks in accordance with the preferred embodiment of the invention.

The block of the subset 1, as shown in FIG. 1, comprises a block of generally triangular shape having an obtuse angle at one of its vertices. The other two vertices define acute angles of less than 45 degrees. The block in FIG. 1 has a side 11 opposite the obtuse angle about $9\frac{1}{2}$ inches long, a second side 13 about $5\frac{5}{8}$ inches long, and a third side 15 about $4\frac{5}{8}$ inches long. Two internal slots 17 and 19 are cut through the triangular block. Each of the slots 17 and 19 are about $1\frac{1}{4}$ inches in length. The slot 17 is arranged parallel to the side 13 located about $\frac{7}{8}$ths of an inch from the side 13. The slot 19 is parallel to the side 15 and located about 1 inch from the side 15. Slots 17 and 19 are located on the opposite sides of and near the geometric center of the block and are spaced about an inch apart. The slot 17 is positioned so as to be about half way between the sides 11 and 13 and the slot 19 is positioned to be about half way between the sides 15 and In addition to the internal slots, the block of FIG. 1 is provided with side slots extending inwardly from the edge of the triangle. One of the side slots 21, about $\frac{3}{8}$th of an inch in length, is located at the obtuse angle vertex and extends perpendicularly toward the side 11. A second side slot 23 extends inwardly from the side 13 parallel to the side 11 and has a length of about $1\frac{1}{2}$ inches. The side slot 23 is located about $\frac{1}{3}$ of the distance from the obtuse angle to the acute angle joining the sides 11 and 13. A side slot 25 also extends inwardly from the side 13 perpendicularly toward the side 11. The slot 25 is about $\frac{3}{8}$ths of an inch in length and is located $\frac{2}{3}$ of the way from the obtuse vertex to the acute angle vertex between sides 11 and 13. A side slot 27 is provided extending from the side 15 perpendicularly to the side 11. The slot about $\frac{3}{8}$ths of an inch in length and is located near the mid-point between the obtuse vertex and the vertex between the sides 11 and 15. Two side slots 29 and 31 extend inwardly from the side 11. The slots 29 and 31 are angled toward each other near the middle of the side 11 about $1\frac{1}{2}$ inches apart with the slot 29 being angled about 45 degrees to the side 11 and the slot 31 being angled about 60 degrees to the side 11. The slots 29 and 31 are each about $\frac{3}{8}$ths of an inch in length.

Figure 2:
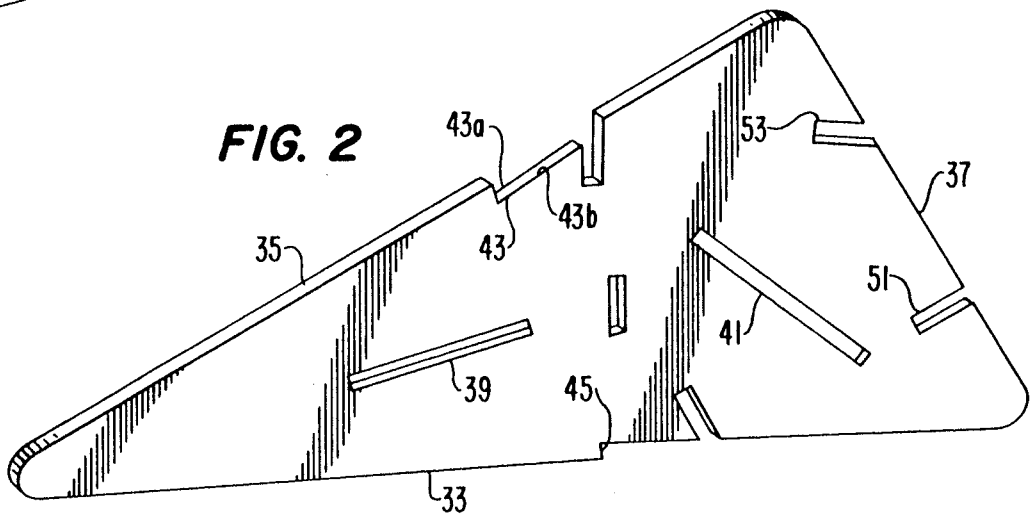

The blocks of the second subset, as shown in FIG. 2, are shaped in the form of a right triangle with one of the other two vertices of the triangle being less than 45 degrees and the other vertex being greater than 45 degrees. As shown in FIG. 2, the side 33 corresponding to the hypotenuse of the triangle is about $6\frac{1}{4}$ inches long. A side 35 about $5\frac{7}{8}$ inches long extends from the right angle vertex to the vertex less than 45 degrees and a side 37 about 3 inches long extends from the right angle vertex to the vertex greater than 45 degrees. An internal slot 39 about $1\frac{1}{4}$ inches long is positioned to approximately bisect the angle at the vertex between the sides 33 and 35 and positioned about $2\frac{1}{2}$ inches from this vertex so as to be more than $\frac{1}{2}$ inch from each of the sides 33 and 35. A slot 41 $1\frac{1}{2}$ inches long is located approximately on the bisector of the angle at the vertex of the triangle between the sides 33 and 37 so that the slot 41 is approximately centrally located with respect to the sides 33 and 37 and also centrally positioned between the side 35 and the vertex between sides 33 and 37. With this arrangement, each of the slots 33 and 42 are well spaced from one another (over one inch) and are each centrally located in different halves of the triangle. A short internal slot 40 about $\frac{3}{8}$ths of an inch in length is arranged perpendicularly to the side 33 and is positioned about midway between the slots 39 and 41. A triangular notch 43 is cut in the side 35 of the block. Triangular notch 43 has a side 43*a* perpendicular to the side 35 and a side 43*b* extending nearly parallel to the side 35 so as to provide a shallow triangular notch configuration. The side 43*a* of the notch is about $\frac{1}{8}$th of an inch in length and the side 43*b* is about $1\frac{3}{4}$ inches in length. The side 43*a* of the notch 43 is located about $2\frac{1}{4}$ inches from the right angle vertex of the triangle. A second shallow triangular notch similar to the notch 43 is formed in the side 33 having its short side near the middle of the side 43 and having its long side extending toward the vertex between the sides 33 and 35. Side slots 47, 49, 51 and 53 are formed extending in from the edges of the triangular block each about $\frac{3}{8}$ths of an inch in length. The side slot 47 is formed in the side 43*b* of the notch 43 and extends perpendicularly toward the side 33. The side slot 49 is formed in the long side of the notch 45 and extends perpendicularly toward the side 35. The two side slots 51 and 53 ar ®formed in the side 37 spaced over an inch part and spaced about $\frac{7}{8}$ths of an inch from the adjacent vertex. The slot 51 near the vertex between the sides 33 and 37 is perpendicular to the side 37 which makes it parallel to the side 35 and the slot 53 near the right angle vertex extends approximately parallel to the side 33.

Figure 3:
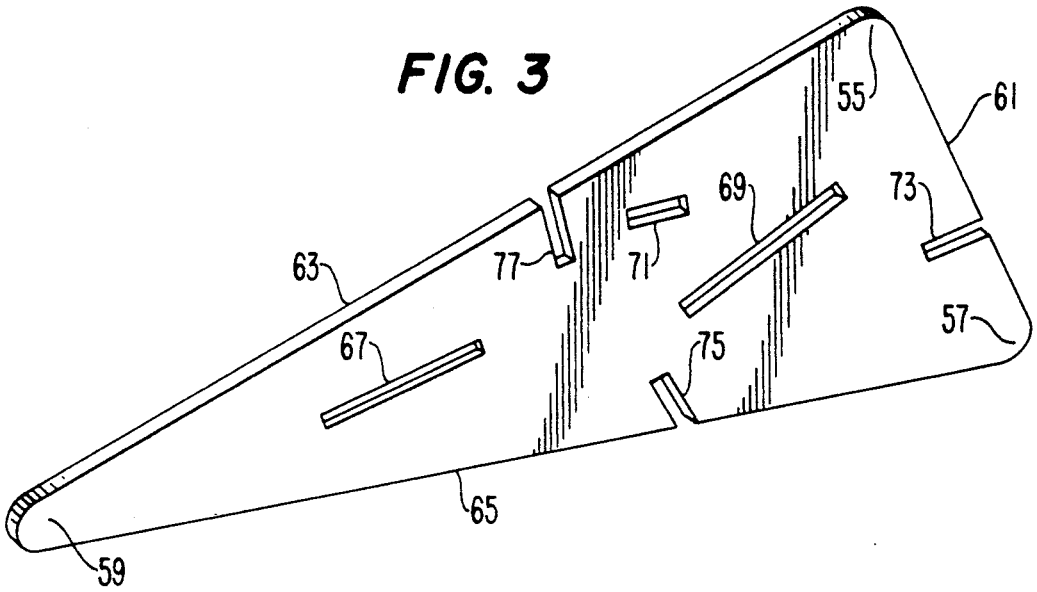

The blocks of the subset shown in FIG. 3 are each in the shape of a triangle defining three acute angles at its vertices. The vertex 55 is about at 85 degrees, the vertex 57 is about 75 degrees, and the vertex 59 is about 20 degrees. The side 61 between the vertices 55 and 57 is about $2\frac{1}{8}$th inches in length. The side 65 between the vertices 57 and 59 is about $6\frac{1}{2}$ inches in length and the side 63 between the vertices 55 and 59 is about $6\frac{1}{8}$ th inches in length. An internal slot 67 about $1\frac{1}{8}$th inches long is formed midway between the sides 63 and 65 extending approximately along the bisector of the angle of the vertex 59 at about 2 inches from the vertex 59. Another internal slot 69 $1\frac{1}{4}$ inches long extends slightly off parallel to the side 63 centrally located relative to the sides 63 and 65 about $\frac{3}{4}$ of an inch from the side 61. The slot 69 is displaced from parallel to the side 63 in a direction to increase its angle to side 65. With this arrangement, the internal slot 67 and internal slot 69 are centrally located in different halves of the triangle. A short internal slot 71 about $\frac{3}{8}$ths of an inch in length extending parallel to the side 65 positioned approximately midway between the slot 69 and the side 63 and opposite the end of the slot 69 remote from the side 61. Side slots 73, 75 and 77 extend in from the edges 61, 65 and 63, respectively, and are each about $\frac{3}{8}$ths of an inch in length. The slot 77 extends perpendicularly toward the side 65. The slot 75 extends perpendicularly toward the side 63. The slots 75 and 77 are both located generally between the internal slots 67 and 69. The slot 73 extends perpendicularly to the side 61 and is located between the slot 69 and the vertex 57.

Figure 4:
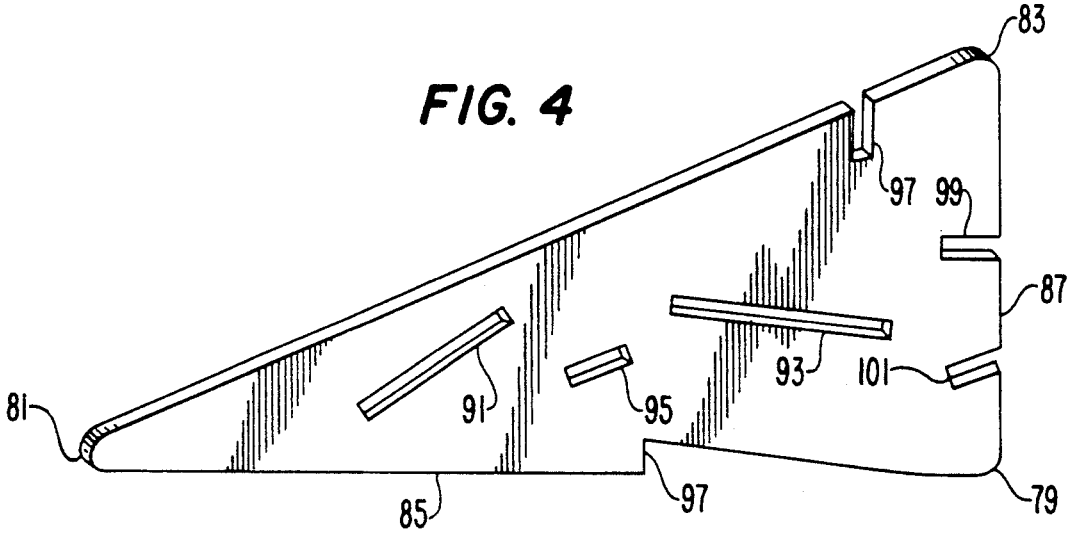

The blocks of the subset illustrated in FIG. 4 are in the shape of a right triangle having a 90 degree vertex 79, a vertex 81 of about 20 degrees and a vertex 83 at about 70 degrees. The side between the 2 vertices 79 and 81 is about $5\frac{3}{4}$ inches in length, the side between the vertices 79 and 83 is about $2\frac{1}{2}$ inches in length and the side between the vertices 81 and 83 is about $6\frac{1}{4}$ inches in length. Internal slot 91 is positioned about midway between the sides 85 and 89 near the vertex 81 and a little displaced from parallel to the side 89 in a direction to increase the angle of the slot 91 relative to the side 85. The internal slot 91 is about $1\frac{1}{8}$th inches in length. Internal slot 93 is positioned about midway between the sides 85 and 89 near the side 87 and is displaced slightly from parallel to the side 85 in a direction to increase the angle of the slot 93 to the slot 89. The slot 93 is about $1\frac{3}{8}$ths inches in length. A short internal slot 95 is positioned between the slots 91 and 93 about halfway between the sides 85 and 89. The slot 95 extends parallel to the side 89 and is about $\frac{3}{8}$ths inches in length. A shallow triangular notch 97 is formed in the side 85 similar to the notch 43 and has a short side about $\frac{1}{8}$th inch in length and one side about $1\frac{3}{4}$ inches in length extending toward the 90 degree vertex 79. A side slot 97 is formed in the side 89 about $\frac{7}{8}$ths of an inch from the vertex 83 extending perpendicularly to the side 85 and is about $\frac{3}{8}$ths of an inch in length. Side slots 99 and 101 are formed in the side 87 on opposite sides of the slot 93 and spaced about $\frac{3}{4}$ of an inch apart. The slot 99 extends perpendicularly to the side 87 and is about $\frac{3}{8}$ths of an inch in length. The slot 101 extends parallel to the side 89 and is also about $\frac{3}{8}$ths of an inch in length.

The arrangement and location of the internal slots and the side slots as well as the angles of the slots, the location and number of the shallow notches and the size and shape of the triangles can vary substantially from the specific embodiment of the subset shown in FIGS. 1–4, the specific location and arrangement of the slots and notches being exemplary. In general, the internal slots should be distributed over the area of the triangle so that more than one block may be inserted into the internal slots without interfering with the other inserted block. To this end, the longer internal slots over an inch in length are preferably separated by an inch or more. Similarly, the side slots should be spaced from one another by at least on the order of $\frac{3}{4}$ of an inch. The minimum spacing between any of the slots should be at least $\frac{1}{4}$ of an inch.

By interconnecting the blocks of the subsets, inserting the vertices of the blocks into the internal slots and the sides of the blocks into the side slots, a highly cantilevered unusual and very airy structure can be built. The shallow triangular notches serve as stabilizing support when one block rests on another block particularly with the side containing the shallow notch is at an angle to horizontal.

Figure 5:
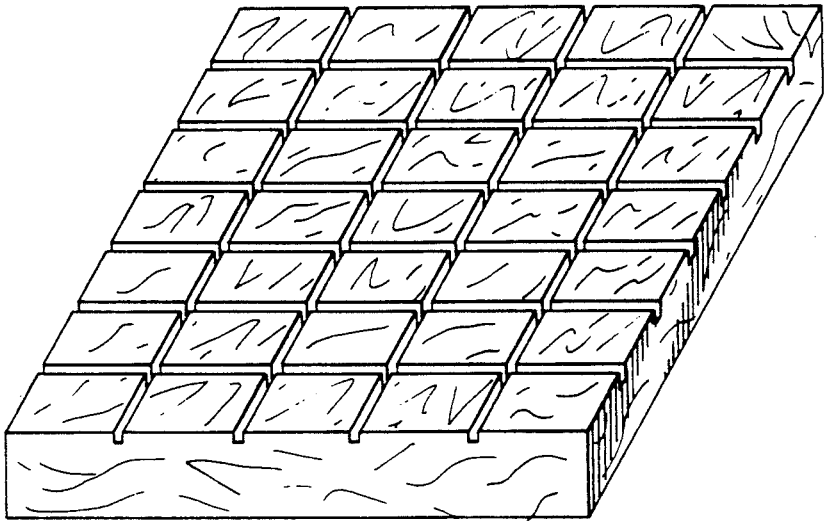
FIG. 5 illustrates a base block to be used with the present invention.

To provide stabilization support for the structure at the base, the base block shown in FIG. 5 may be used. As shown in FIG. 5, the base block comprises a rectangular block provided with a first set of parallel grooves 103 cut about ¼ of an inch into the top of the block and a second set of parallel grooves 105 perpendicular to the grooves 103 also cut ¼ of an inch into the top of the block. Each of the grooves 103 and 105 is a little greater than ⅛th of an inch wide so that the triangular blocks can be vertically supported in the grooves.

Figure 6:
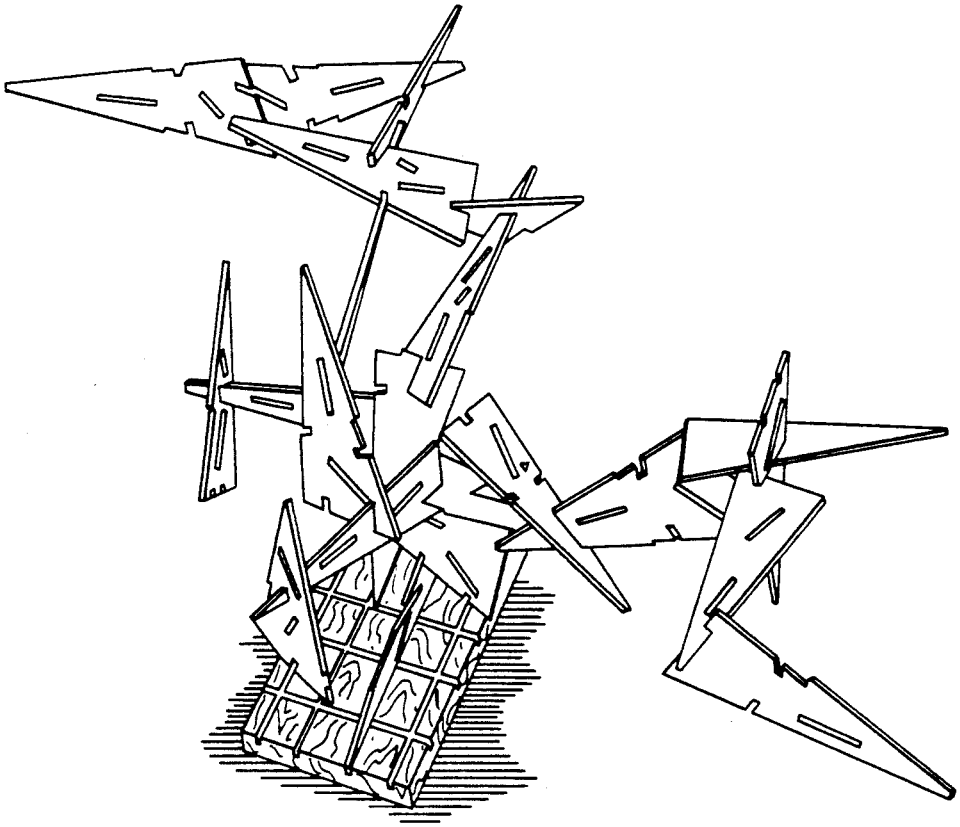
FIG. 6 is an example of how the blocks can be and in fact have been assembled by children playing with the blocks.

FIG. 6 illustrates an example of an airy, cantilevered structure can be developed from just a few of the blocks of a block set corresponding to the present invention.

The ability of the young child to build unusual airy shapes like that shown in FIG. 6 is what makes the block set of the present invention have high play value and makes the block set a much desired toy for younger children. In addition, the fact that the blocks can be tesselated into familiar shapes makes the block set an educational toy for geometry and mathematics.

The above description is of a preferred embodiment of the invention and many modifications may be made thereto without departing from the spirit and scope of the invention, which is defined in the appended claims.

We claim:

1. A set of blocks comprising a multiplicity of thin, triangular sheets, each of said blocks having a plurality of separate internal linear slots comprising four-sided rectangular openings in sheet defined by two parallel sides and two closed ends extending between said parallel sides and having a plurality of side slots extending inwardly from the perimeter of the triangular form of said blocks, each of said internal slots extending in different directions, each of said side slots being open at one end to the perimeter of said blocks, each of said slots having a width slightly greater than the thickness of the sheets of said blocks and a length greater than said width, and each of said side slots having at its open end a width slightly greater than the thickness of the sheets, the sheets of said blocks having sufficient thickness that said blocks will support one another in a cantilevered structure in said slots.

2. A set of blocks as recited in claim 1, wherein said set comprises a plurality of subsets, each subset containing a plurality of identically shaped blocks, and the blocks of different subsets being in the shape of a different triangle.

3. A set of blocks as recited in claim 1, wherein some of said blocks have a shallow triangular notch defined in a linear side of the triangular form of such blocks, said notch having one side perpendicular to the side of the triangle in which the notch is formed and a second side extending nearly parallel to the triangular side in which the notch is formed, said second side of the notch being substantially longer than the first side of the notch.

4. A set of blocks as recited in claim 1, further comprising a base block- having an upper flat surface, means to support said upper flat surface to be horizontal, and means defining a plurality of grooves in said upper flat surface, said grooves having a width slightly greater than the width of said thin triangular sheets.

5. A set of blocks as recited in claim 4, wherein said grooves in said base block comprise a first set of parallel grooves and a second set of parallel grooves extending perpendicular to said first set of grooves.

6. A set of blocks as recited in claim 1, wherein said triangular sheets are each in the form of a scalene triangle.

7. A set of blocks as recited in claim 1, wherein the triangular shape of each of said blocks has an angle at one vertex which is less than 45 degrees.

8. A set of blocks as recited in claim 1, wherein a subset of said blocks are in the shape of identical triangles having an obtuse angle at one vertex.

9. A set of triangular blocks as recited in claim 1, wherein a subset of said blocks are in the shape of identical triangles having a right angle at one vertex.

* * * * *